United States Patent [19]

Peszeszer

[11] 4,002,304

[45] Jan. 11, 1977

[54] METHOD AND APPARATUS FOR STRESSING A TENDON AND BANDING A STRUCTURE

[75] Inventor: Endre F. Peszeszer, San Diego, Calif.

[73] Assignee: General Atomic Company, San Diego, Calif.

[22] Filed: June 6, 1975

[21] Appl. No.: 584,337

[52] U.S. Cl. ..... 242/7.21
[51] Int. Cl.[2] ..... B21F 17/00
[58] Field of Search ..... 242/7.21, 7.22, 7.23

[56] References Cited

UNITED STATES PATENTS

| | | | |
|---|---|---|---|
| 3,666,189 | 5/1972 | Dykmans | 242/7.21 |
| 3,822,167 | 7/1974 | Piola | 242/7.21 X |

*Primary Examiner*—Jerry W. Myracle
*Attorney, Agent, or Firm*—Fitch, Even, Tabin & Luedeka

[57] ABSTRACT

A method and apparatus are disclosed for circumferentially banding a circumferential wall of a large vessel with a highly tensioned tendon. The carriage is suspended from the top of the structure and constrained into contact with the wall to travel circumferentially about the vertical structural wall. The carriage is propelled forwardly during banding against the large restraining force, e.g., 30,000 lbs. or more, from the tendon which is connected to the wall by a belt drive means on the carriage which is in driving engagement with upper and lower belts looped about the vessel and extending through the carriage. The belt drive means comprises belt drive drums about which the belts travel after being lifted from the structural wall at the forward end of the carriage. The belts are returned to the structural wall at the rear end of the carriage. A regenerative hydraulic system includes hydraulic pumps connected to the tendon tensioning system and provides a hydraulic force assist to the belt drive drums to propel the carriage. Preferably, the belt drive drums comprise a pair of rotatable hydraulic motors with a belt drive rim fastened about their peripheries.

17 Claims, 11 Drawing Figures

METHOD AND APPARATUS FOR STRESSING A TENDON AND BANDING A STRUCTURE

This invention relates to an apparatus and a method for prestressing structures by banding them circumferentially with tensioned tendons and more particularly to an apparatus and method in which a carriage travels about a structural wall while tensioning the tendon and paying out the tensioned tendon to the structural wall.

The present invention is directed to apparatus capable of banding extremely large upright cylindrical structures, for example, 75 to 300 feet in diameter, with a large size, tensioned tendon being paid out at a high rate of speed from the apparatus to the structure. More specifically, the preferred tendons are high tension steel cables having diameters as large as 0.6 inch diameter and these preferred tendons are highly stressed to 30,000 pounds or more. When banding large vessels and laying multiple layers of tendon in grooves in the vessel wall, the apparatus may have to lay over a thousand miles of tendon. In order to meet construction time schedules and to band at a reasonable cost, the apparatus should be capable of operating at high speeds and should be reliable to limit stoppages and downtime for repairs and maintenance.

One apparatus developed for such a laying of tendons is disclosed in U.S. Pat. 3,687,380; and another apparatus is disclosed in co-pending application Ser. No. 574,900 filed May 6, 1975 entitled "Method and Apparatus for Banding Vessels With Prestressed Tendons," assigned to the assignee of the present invention. The latter application discloses an apparatus having a vertically suspended wheeled carriage with four sets of traction wheels having tires for rolling circumferentially about the upright cylindrical structural wall and for propelling the carriage about the structure during the laying of the tendon. The tendon tensioning mechanism on the carriage must exert a pull or restraining force on the tendon to tension it to over 30,000 pounds without the carriage wheels slipping on the vessel wall. To prevent such slippage of the carriage wheels on the vessel wall, high normal forces are applied by the carriage to force the wheels tightly against the wall of this results in high loads being applied to the tires and the wheel bearings.

While the apparatus of the foregoing kind operates satisfactorily, these very high normal forces lead to considerable wear and reduction in the life of the tires, particularly where the tires are not perfectly aligned and also because the surface of the concrete structure is rough and uneven. In addition to the wear caused by the high, normal forces to prevent slipping of the driving wheels, the tires of these traction wheels are also subjected to high shear forces because of the high torques applied thereto and this also further shortens the life of these tires. When one tire wears excessively relative to other tires, it must be replaced to prevent slipping as the carriage wheels are mechanically ganged together in a set of wheels. Either all of the tires of a wheel set must be replaced to provide uniform diameter tires for the wheel set or else the newly replaced tire must be machined down to the diameter of the other tires of the wheel set to prevent slippage of one wheel.

In both the Caterpillar traction drive disclosed in U.S. Pat. No. 3,687,380 and in the wheeled carriage drive described above, high axial bearing loads are also a considerable problem as they are a source of bearing failure. These bearing loads and wheel loads also vary considerably in accordance with the location of the strand being laid. This is because the tendon tensioning mechanism shifted vertically on the carriage and the load was concentrated either on the upper or lower part of the carriage. For instance, when the strand was being laid in a groove near the upper end of the carriage the upper carriage wheel received a bearing load as high as 3,000 pounds per wheel greater than when the strand was being laid in a groove near the lower end of the carriage.

In such wheeled carriages, the length of the carriage has been made quite long in order to spread the distance between the wheels to provide predetermined wheel loads for a given size of vessel. Thus, the span between the sets of driving wheels of a carriage designed for a smaller diameter vessel may be too short for use with other significantly larger diameter vessels. For example, the wheel span for some carriages has limited their capabilities to use of vessels which range from 70 to 150 feet in diameter. For larger diameter vessels, a carriage of large length is needed to space the frictional drive wheels within a range of desired normal forces applied by the circumferential restraining means.

Accordingly, a general object of the invention is to provide an improved, as contrasted with the prior art, apparatus and method for prestressing a structure.

Other objects and advantages of the invention will become apparent from the following detailed description taken in connection with the drawings in which.

Figure 1:
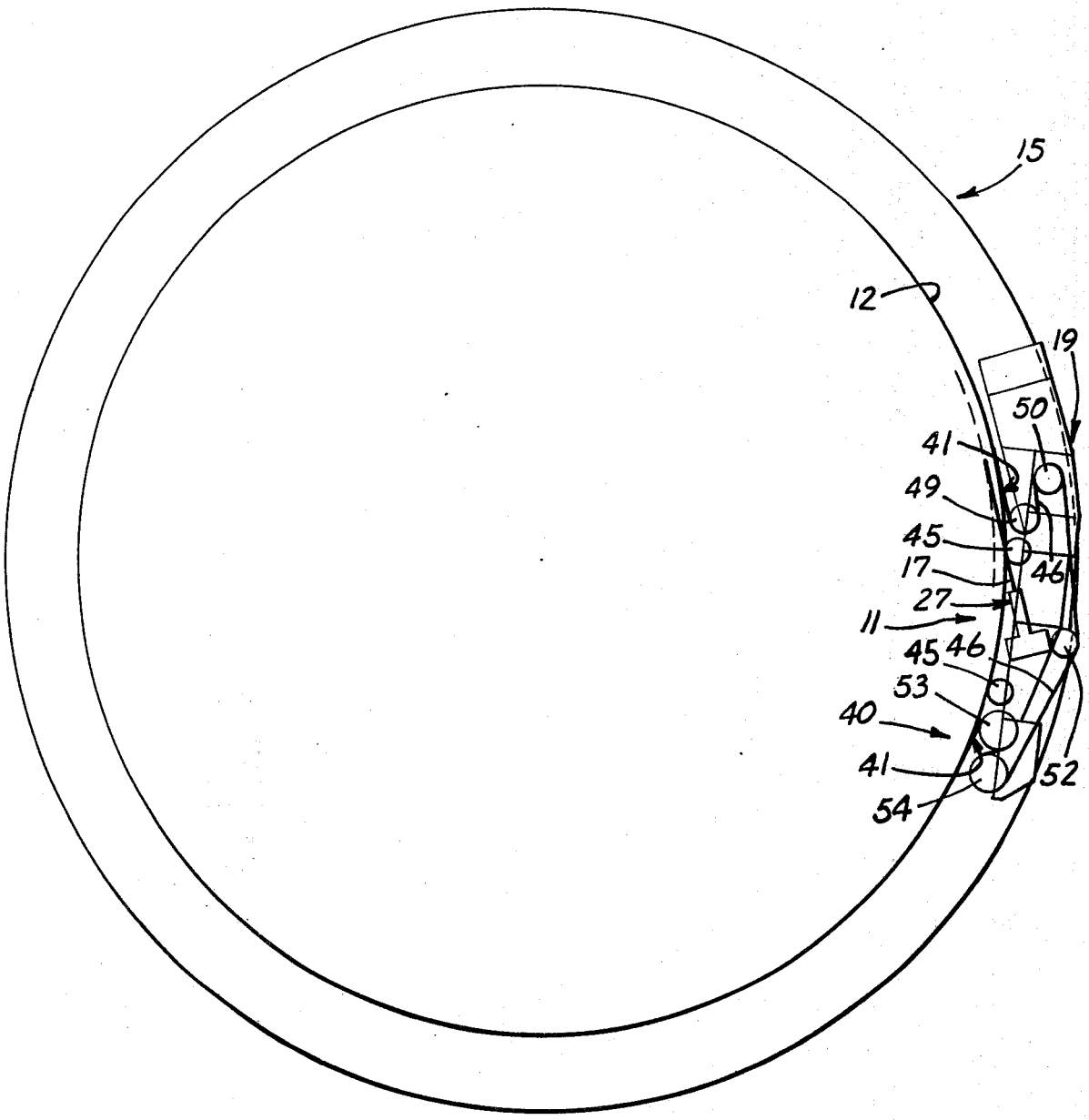
FIG. 1 is a schematic illustration of a plan view of a wire winding apparatus constructed in accordance with the preferred embodiment of the invention.

As shown in the drawings for purposes of illustration, the invention is embodied in an apparatus 11 for banding a wall 12 of a structure 15, such as a restraining barrier tank formed of concrete or reinforced concrete or steel with stressed tendons 17. These highly stressed tendons develop compressive forces in the wall to prestress the structures circumferentially before the internal pressure is applied to the walls from within. By way of example, apparatus of the foregoing kind is intended to band very large structures, for example, from 70 feet to 300 feet in diameter or larger, with large tendons, for example, 0.6 inch diameter steel cables which must be laid at relatively high speeds to provide an economic manner and method of banding such a structure. Where, for example, 1,200 miles of such tendon must be wound on the structure, the apparatus is required to operate at high speed, such as 300 feet per minute. Often the tendons are stressed to 30,000 to 37,000 pounds of tension and are stressed relatively high compared to their yield strength, e.g., 75 percent of the yield strength of the diameter cable being used.

Figure 3:
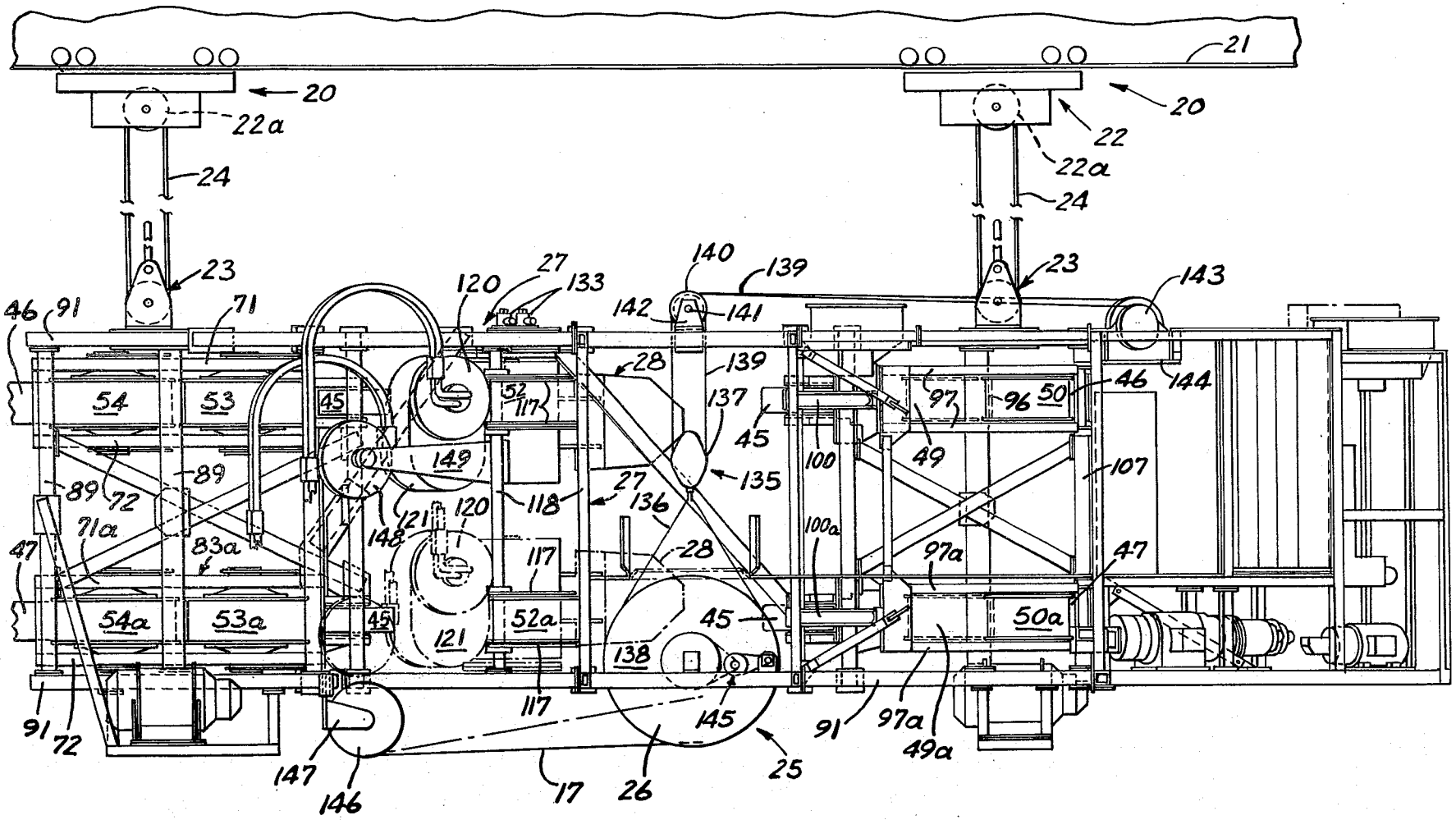
FIG. 3 is a side elevational view of the wire winding apparatus of FIG. 2.

The tendon 17 issues from a traveling carriage 19 which is suspended vertically by a suspension system 20 (FIG. 3) which is secured to the top of the structure for movement circumferentially about the entire circumference of the circular wall 12, as is fully disclosed in U.S. Pat. No. 3,687,380. The suspension system 20, as best seen in FIG. 3, comprises an overhead circular track 21 supporting a series of trolley units 22 which roll along the track. Each of the trolley units 22 carries a pulley unit 22a from which depend suspension cables 24 to hydraulically powdered hoist units 23 on the carriage. The hoist units 23 wind or unwind the suspension cables and by adjusting the length of the suspension cables 24, the carriage 19 may be shifted vertically along the wall.

Figure 2:
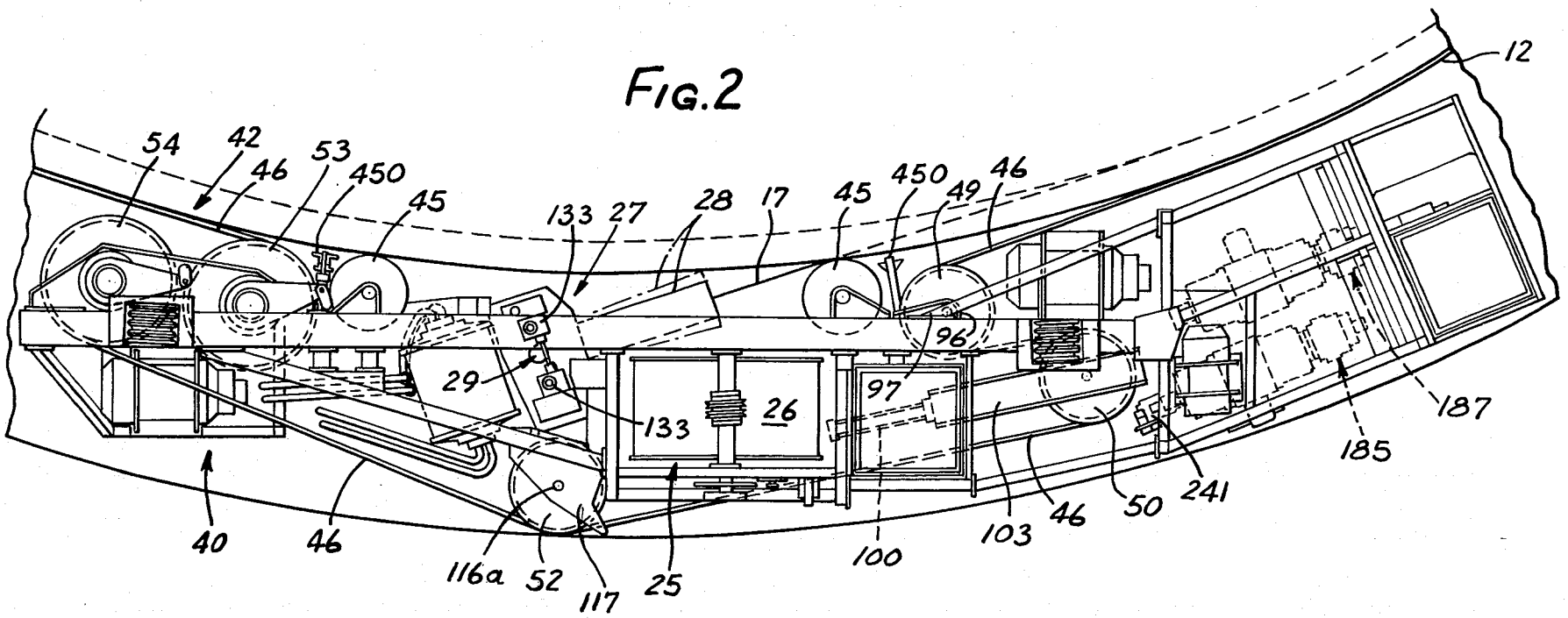
FIG. 2 is a plan view of the wire winding apparatus shown in FIG. 1.
Figure 4:
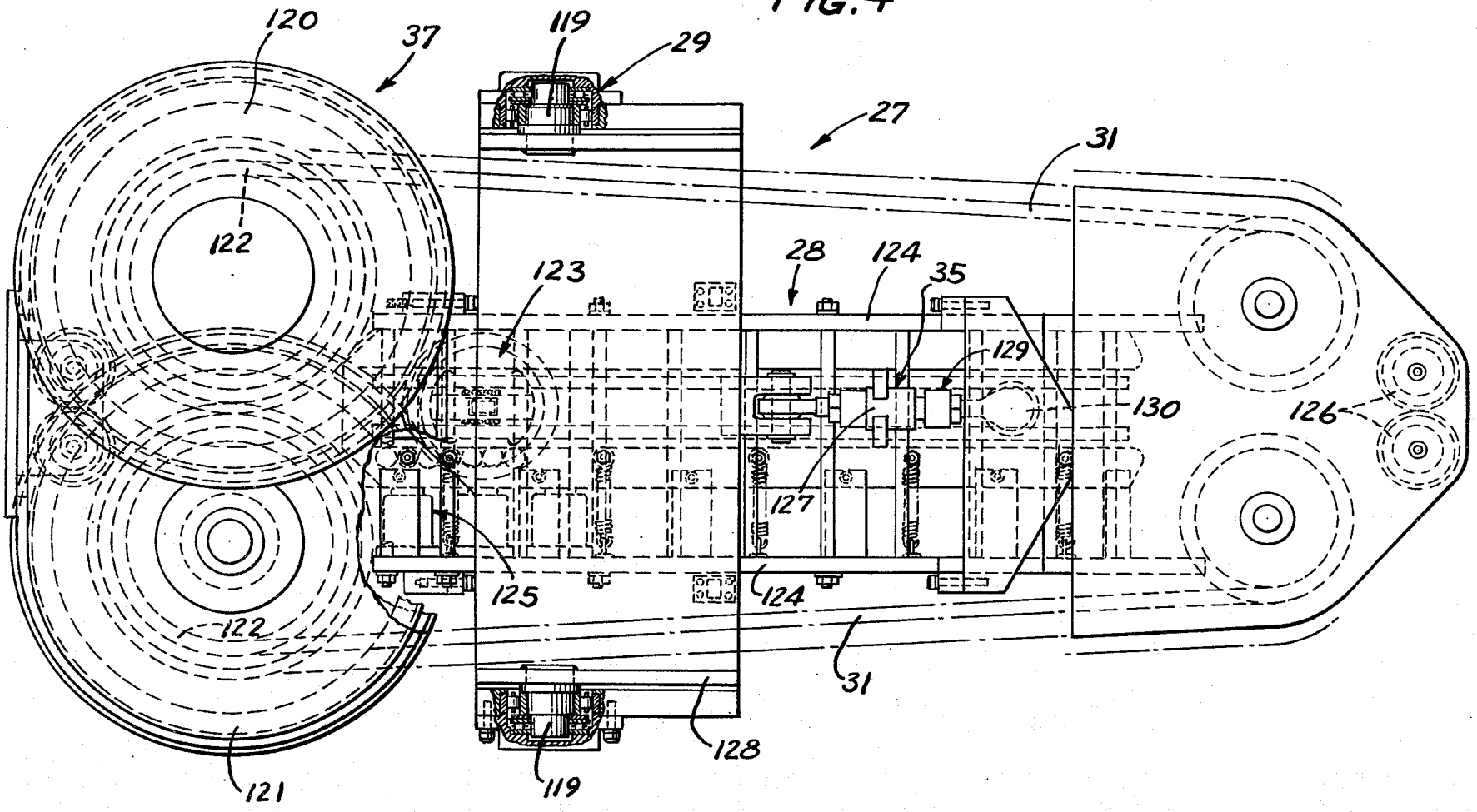
FIG. 4 is an enlarged partially sectional view of a tendon tensioning mechanism for use with the apparatus of FIG. 3.

On the carriage 19 is a reel means 25 which carries a large spool 26 on which is wound a coil of unstressed tendon 17 whih is unwound from the spool and paid out to a tendon tensioning mechanism 27 which tensions the tendon and pays out the tensioned tendon to the wall. The tendon tensioning mechanism illustrated herein is substantially identical to that described in the aforementioned co-pending application and is generally similar to that disclosed in aforementioned U.S. Pat. No. 3,687,380 is that the tendon travels along a straight line path through the tendon tensioning mechanism, the path being aligned with a tangent line to the wall. As disclosed in that patent and as shown in FIGS. 2 and 4 herein, the tendon tensioning mechanism 27 includes a prestressing unit 28 which is mounted by an articulating means 29 which allows the prestressing unit to pivot about a vertical axis to maintain the straight line tangential path for the tendon 17 through the prestressing unit and therefrom to the wall of the structure thereby eliminating substantial bending stresses which tend to crack or to be a source of cracks or ultimate failure for these highly stressed tendons. This pivotal movement is indicated by the dotted line portion illustrated for the prestessing unit in FIG. 2. The prestressing unit 28, as best seen in FIG. 4, comprises a pair of endless bands 31 each carrying a series of restraining elements thereon which are opposed and on opposite sides of the tendon to grip the tendon therebetween and apply a restraining force to the tendon 17 as the carriage 19 is driven in a forward or reverse direction relative to the wall. Means in the form of a load cell means 35 co-operates with the prestressing unit 28 to measure the tension in the tendon; and signals from the load cell means 35 are used to control a hydraulic system which increases or decreases the torque applied to hydraulic motor pump means 37 which controls the restraint afforded by the endless bands 31. As disclosed in the aforementioned patent, the hydraulic pump means 37 is a portion of a regenerative hydraulic system in which work developed within the tendon tensioning mechanism during restraint of the tendon is used as an assist for a drive means to propel the carriage about the structural wall 12.

In the aforementioned patent and the co-pending patent application, the traveling carriage 19 was constrained against the wall of the vessel by a pair of restraining cables which extended circumferentially about the vessel and were shortened to apply a normal or radial force to push the carriage tightly against the structural wall and thereby establish traction between the structural wall and the traction drive means (Caterpillar tracks in the patent and rolling wheel drive in the aforementioned pending patent application). The co-pending application also discloses a circumferential restraining system formed of a series of wheeled and hinged link units extending circumferentially about the structure and connected to the carriage in a manner to force the carriage traction wheels tightly against the carriage wall. The carriage traction wheels were driven by hydraulic motors to propel the carriage and link units with the series of circumferentially spaced idler wheels on the link units rolling about the structural wall. Irrespective of the construction used for the circumferential restraining system, its primary function was to provide sufficient normal force, that is, normal to the structural wall 12, to establish sufficient traction and friction between the carriage traction drive means and the structural wall to prevent slipping of the wheels or traction tracks on the wall particularly during the tendon tensioning and laying operation. By way of example, when tensioning tendons to 37,800 pounds, the circumferential restraining systems were required to apply about 10,000 to 12,000 pounds of radial force at each of the wheels to prevent slippage of these wheels on the structural wall. In addition to these high forces applied normally to the wheels, the tendon 17, which was anchored at one end to the wall 12, exerted a pull of 30,000 pounds restraining the carriage from moving forwardly. Thus, to propel the carriage forwardly against these loads, the driving motors applied large torque forces to the wheels and caused high shear forces to be applied to the tires. Indeed, the life of the tires became a limiting factor in this design.

In accordance with the present invention, the carriage 19 is propelled about the structural wall 12 while tensioning and paying out a tendon 17 to the wall by means of a carriage drive means 40 which comprises a belt means 41 looped about the structural wall and passing through a belt drive means 42 mounted on the carriage 19 for engaging and pulling on the belt means with sufficient force to cause carriage wheels 45 to roll about the structural wall without applying high driving torques and shear forces to the tires on the carriage wheels. Preferably, the belt drive means 42 comprises belt drive drums 53 and 54 which have belt means wrapped thereon and in driving engagement therewith to pull the carriage about the structure.

The preferred belt means 41 comprises an upper wide flat belt 46 and a lower wide flat belt 47 (FIG. 3) which provide much larger surfaces to accommodate the loads than do the smaller wall engaging surfaces of the prior art driving wheels. More specifically, because the belt surface area in contact with the vessel wall is considerably greater than the surface area of the prior art drive wheels or traction devices disclosed in the aforementioned patent or co-pending application, the per unit force applied to the belt is reduced substantially to provide a longer life for the belts 46 and 47. The upper belt 46 is driven by the drive belt drums 53 and 54 with the lower belt 47 being driven by a similar pair of lower drive belt drums **53*a* and 54*a***. The belts 46 and 47 also act as a circumferential restraint to apply normal forces to the carriage to hold it against the structural wall 12 while non-driven wheels 45 on the carriage 19 roll about the structural wall. As will be explained in greater detail, the belt drive drums apply driving torque to the belts which are wrapped about these drums with a moderate pretension. The belts 46 and 47 are lifted from engagement with the structural wall as the carriage travels forwardly but the belts 46 and 47 do not travel or slip circumferentially to any substantial degree as the carriage travels about the structural wall. This is because of the large circumferential wrap and frictional surface engagement between the belts and the wall. Thus, the carriage moves circumferentially about the wall with sections of the belts being merely lifted from and returned into engagement with the wall as different sections of the belts pass through the belt drive drums.

Turning now in greater to the illustrated embodiment of the invention, each of the illustrated belts 46 and 47 are 16 inches in width and are comprised of 24 5/16 inch diameter steel cables 46*a* are spaced about 0.66 inches between centers and imbedded in rubber and fabric (FIG. 5) and covered by an outer ¼inch thick cushion 47*a* of rubber. During the course of the carriage travel about the structure, the belts are stretched and the rubber cushion, which skids on the concrete wall, experiences wear. However, because of the large surface areas for the belts 46 and 47 and the lack of substantial shear forces on the belts, they experience a significantly longer life than the wheel tires which receive the driving torque in the aforementioned pending application. Whereas, the tires of such apparatus have not lasted for the 1,200 miles of a typical banding operation, the belts 46 and 47 may last that long.

The forces applied to the carriage 19 by the belts 46 and 47 and the movement of the carriage is balanced to prevent skewing of the carriage by having the belts 46 and 47 travel along identical upper and lower paths through the carriage 19. More specifically, the upper belt 46 extends from the structural wall of the vessel, as seen in FIGS. 1 and 2, to an upper pulley or idler drum 49 on the trailing or rearward end of the carriage with the belt being wrapped around for approximately 180° from its interiorly facing side to its outer facing side from which the belt 46 travels through a short run in the rearward direction to engage the interiorly facing side of another upper idler drum 50. The belt is wrapped for another approximately 180° about the idler drum 50 and leaves at the outer side thereof for travel to another centrally located idler belt drum 52 from which the belt travels forwardly to the front of the carriage. The belt is wrapped from the outer side of the forward belt drive drum 54 foremost on the carriage through about a 270° wrap before it leaves for a short travel to the other belt drive drum 53 at which the belt is again wrapped for about 270° to discharge from the latter to travel across a short gap to the wall 12 at the front of the machine. The above-described path of the upper belt 46 through the drums is duplicated on the lower part of the carriage 19. Therefore, the similarly situated drums have been given reference characters with a suffix *a* added and need not be described in further detail. Thus, it will be seen that the belts not only co-operate with the belt drive drums to provide the traction force but alos because of the tension in these belts apply the normal force to hold the four carriage wheels 45 in engagement with the wall of the structure. Ends of the belts are threaded through the carriage and then are spliced to form endless bands. The belts are shifted vertically by a hoist mechanism (not shown) operable when the hoist mechanism 20 shifts the carriage.

Figure 5:
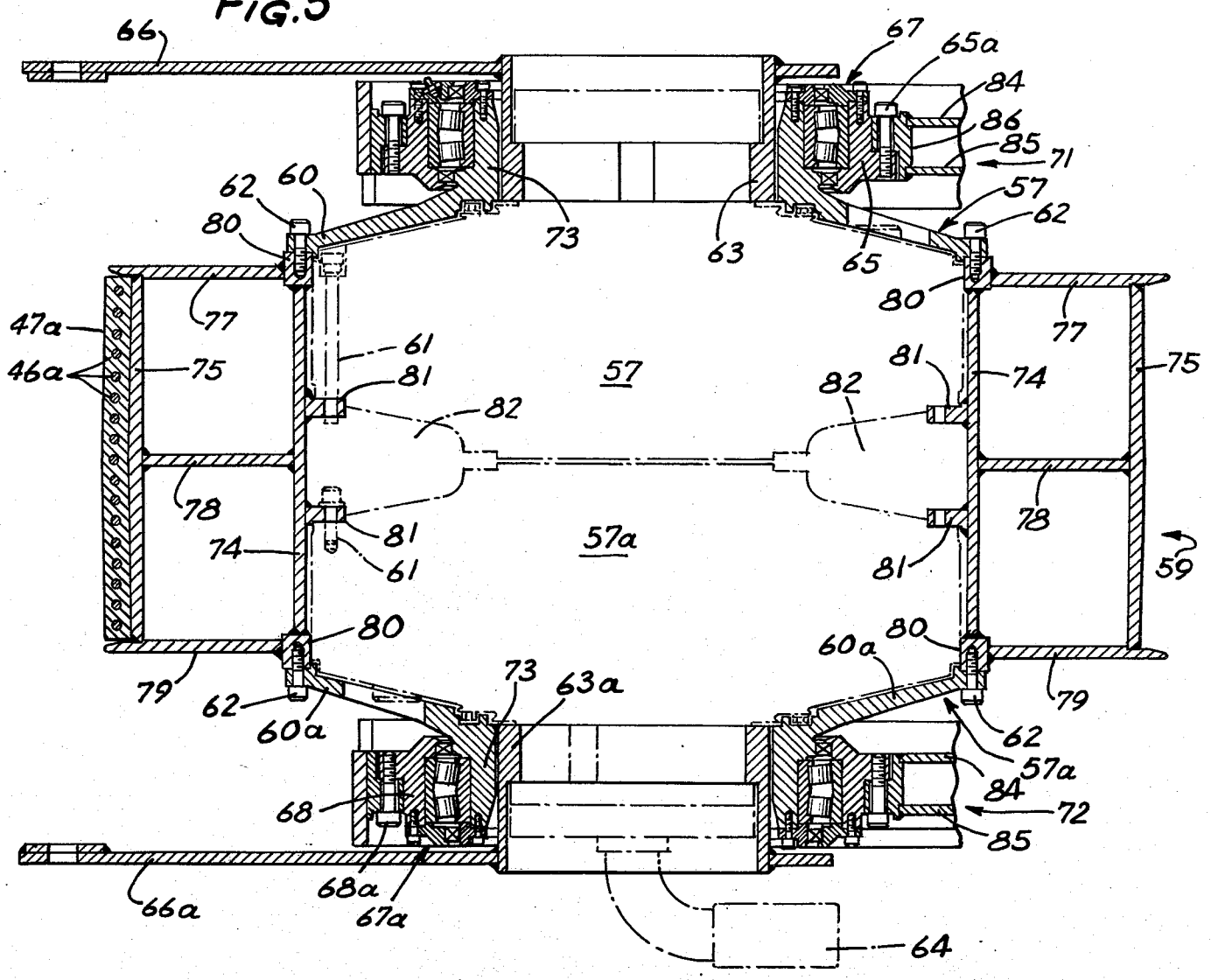
FIG. 5 is an enlarged cross-sectional view of a belt drive drum means.

In accordance with an important aspect of the invention, the belt drive means 42 comprises an efficient high torque drive at a relatively low r.p.m. without the use of speed reducers or gear boxes by a unique arrangement of pancake-shaped hydraulic motors 57 and 57*a*, as best seen in FIG. 5, mounted internally of an outer encircling drum rim 59. More particularly, the hydraulic motors 57 and 57*a* are coaxially superimposed to turn about a central vertical axis with their outer rotating portions or races 60 and 60*a* secured by a series of circumferentially spaced bolts 61 and 62 to the drum rim 59. The inner central hub portions 63 and 63*a* of the hydraulic motors 57 and 57*a* are stationary and are carried by and mounted on a pair of horizontally extending, stationary frame sections 71 and 72 on the carriage 19, as will be explained later. Hydraulic fluid is supplied to and exhausted from the center hub portions of the motors, as indicated generally by one hydraulic line 64 shown in FIG. 5 and as will be explained in detail in connection with the hydraulic circuit shown in FIG. 10. Each of the hubs is held against turning by an attached torque arm 66 and 66*a* which is secured to the carriage frame in a manner explained hereinafter. These motors are preferred as they eliminate the inefficiencies and breakdowns encountered when using gear reducers and other devices positioned between a higher speed motor and the driving unit, such as the Capterpillar tracks used in the aforementioned patented device. The preferred motors 57 and 57*a* are manufactured in Sweden and are Hagglund Hydraulic motors, Series 4170, and operate at 1800 to 2800 p.s.i., with a flow rate of 60 to 70 g.p.m. at 30 to 38 r.p.m. speed.

The hub 63 for the upper motor 57 is mounted in an upper bearing 67 carried in a bearing mount 65 fastened by bolts 65*a* to the frame section 71 while the hub 63*a* for the lower motor 57*a* is mounted in a similar lower bearing 67*a* carried in a bearing mount 68 fastened by bolts 68*a* to the stationary frame section 72. The rotating race portions 60 and 60*a* of these motors have central intermediate circular flanges 73 rotatably mounted between the inner hubs 63 and 63*a* and the surrounding bearings 67 and 67*a*. Thus, hydraulic fluid enters over the line 64 at the central stationary hubs 63 and 63*a* which are held against rotation by the torque arms 66 and 66*a* and the exhausted, low pressure fluid also flows through these central stationary hubs after having imparted the turning torque to the outer race portions 60 and 60*a* of these motors to turn the belt driving rims 59 about which is wrapped a belt.

Herein, the drum rim 59 is formed with an outer circular metal ring 75 for engaging the belt and an interior coaxial ring 74 encircling the peripheries of the motors. Preferably, the exterior of the metal ring 75 is crowned at the center to assist the belt in tracking on the drum. Three annular, radially oriented rib plates 77, 78 and 79 extend between the outer metal ring 75 and an inner metal ring 74. The center rib 78 is welded directly to the outer and inner rings. To assist in fastening the rim 59 to the motor races, a pair of thicker cross section circular members 80 are welded at the junctures between the ribs 77 and 79 and the inner ring 74. These latter circular members 80 seat in corners of the motor drums and are secured thereto by the circular array of screw fasteners 62. A pair of circular flanges 81 are secured to the inner side of inner metal ring 74 and project into a cavity 82 between the motors 57 and 57*a* and are fastened by the screws 61 to the rotatable motor frames. Thus, the fasteners 61 and 62 fasten the drum rim 59 to the rotatable exterior motor frames of the hydraulic motors 57 and 57*a* to constitute belt driving drums 53, 53*a*, 54 and 54*a*.

Figure 6:
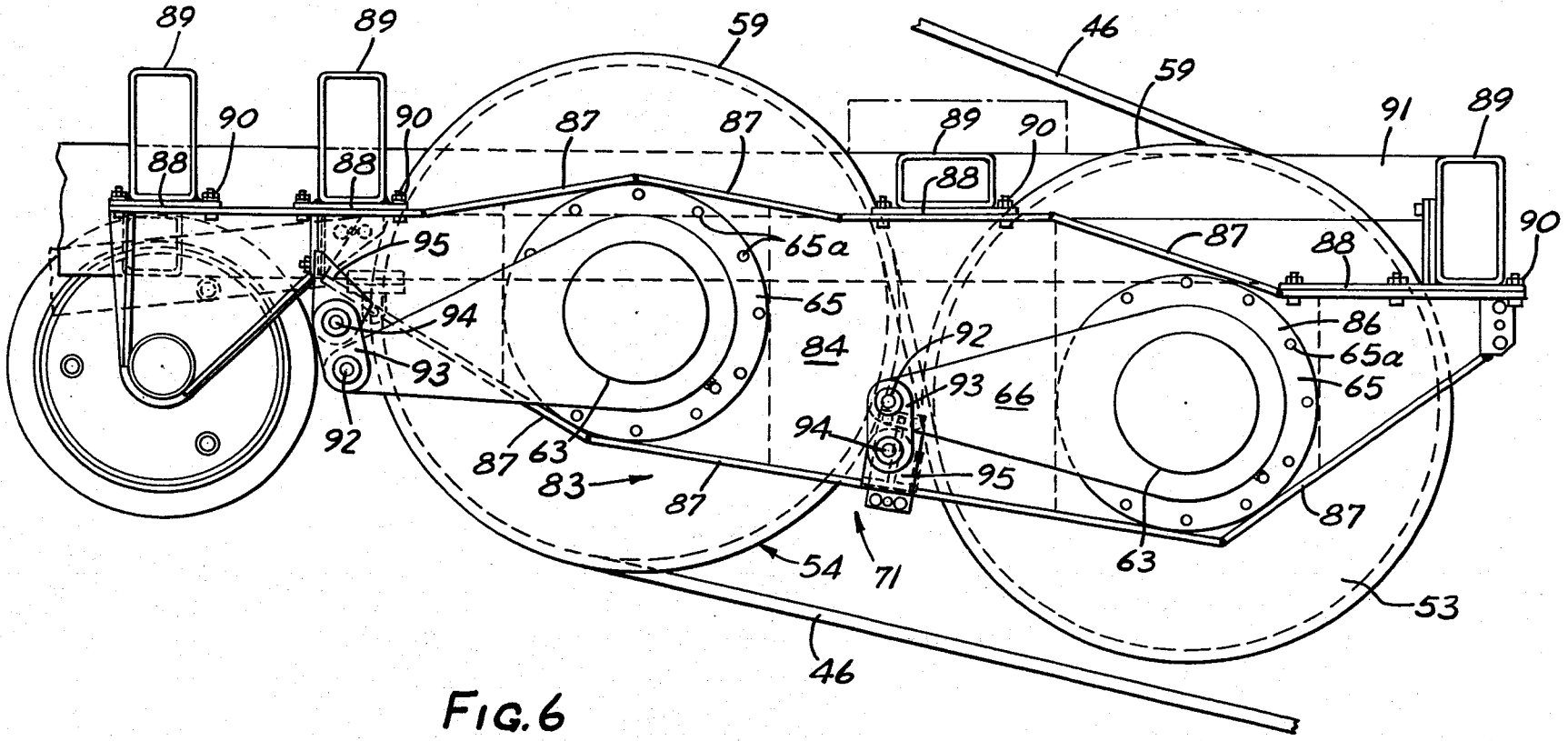
FIG. 6 is a plan view of a pair of upper belt drive drum means for use with the apparatus of FIG. 3.

As best seen in FIGS. 3 and 6, the upper belt drive drums 53 and 54 are mounted in a sub-frame 83 having an upper horizontally extending frame section 71 mounting the upper bearings 67 and a lower frame section 72 mounting the lower bearings 67*a*. As the upper and lower sections 71 and 72 are identically constructed, only the upper section 71 will be described. A pair of closely adjacent, horizontally extending plates 84 and 85 (FIG. 5) support the upper portions of the bearing mounts 65 in a shouldered annular retainer 86 with the mounts 65 being secured thereto by the bolts 65*a*. A series of flat, vertical strips 87, as best seen in FIG. 6, are welded to and along the peripheral edges of the plates 84 and 85 to add substantial rigidity and strength to these motor supporting frame sections.

Each of the frame sections 71 and 72 is bolted by bolts 90 to brackets 88 which in turn are fastened to upstanding carriage frame posts 89, as best seen in FIG. 6. The carriage 19 is comprised of a large number of such vertical posts 89 which, as best seen in FIG. 3, extend vertically between top, horizontally extending beams and the lower horizontally extending beams 91 to define a light weight but very strong main carriage frame.

To assure that the hubs 63 and 63*a* of the hydraulic motors 57 and 57*a* do not turn in their bearings 67 and 67*a*, the upper and lower torque arms 66 and 66*a* are keyed to the hubs and are joined to the respective frame sections 71 and 72 at their outer ends. More specifically, each torque arm extends outwardly across its frame section to a narrow outer end thereon which is apertured and receives a pin 92 therein joining the arm to a short link 93. The link is joined at its opposite end by a pin 94 to a bracket 95 fastened to a frame section 71 or 72. Thus, the hubs 63 and 63*a* are restrained from rotating by the torque arms acting through the links connected to the stationary frame sections.

Turning now to the opposite and the trailing end of the carriage 19, it is held tightly against the wall 12 by the upper and lower belts 46 and 47 which are looped about the drum 50 and the drum 49 to travel past these drums before returning to the structural wall. The drum 49 includes a central rotatable hub 96 (FIG. 2) mounted for rotation about a fixed vertical axle carried by stationary frame sections 97 secured to the main carriage frame.

Figure 7:
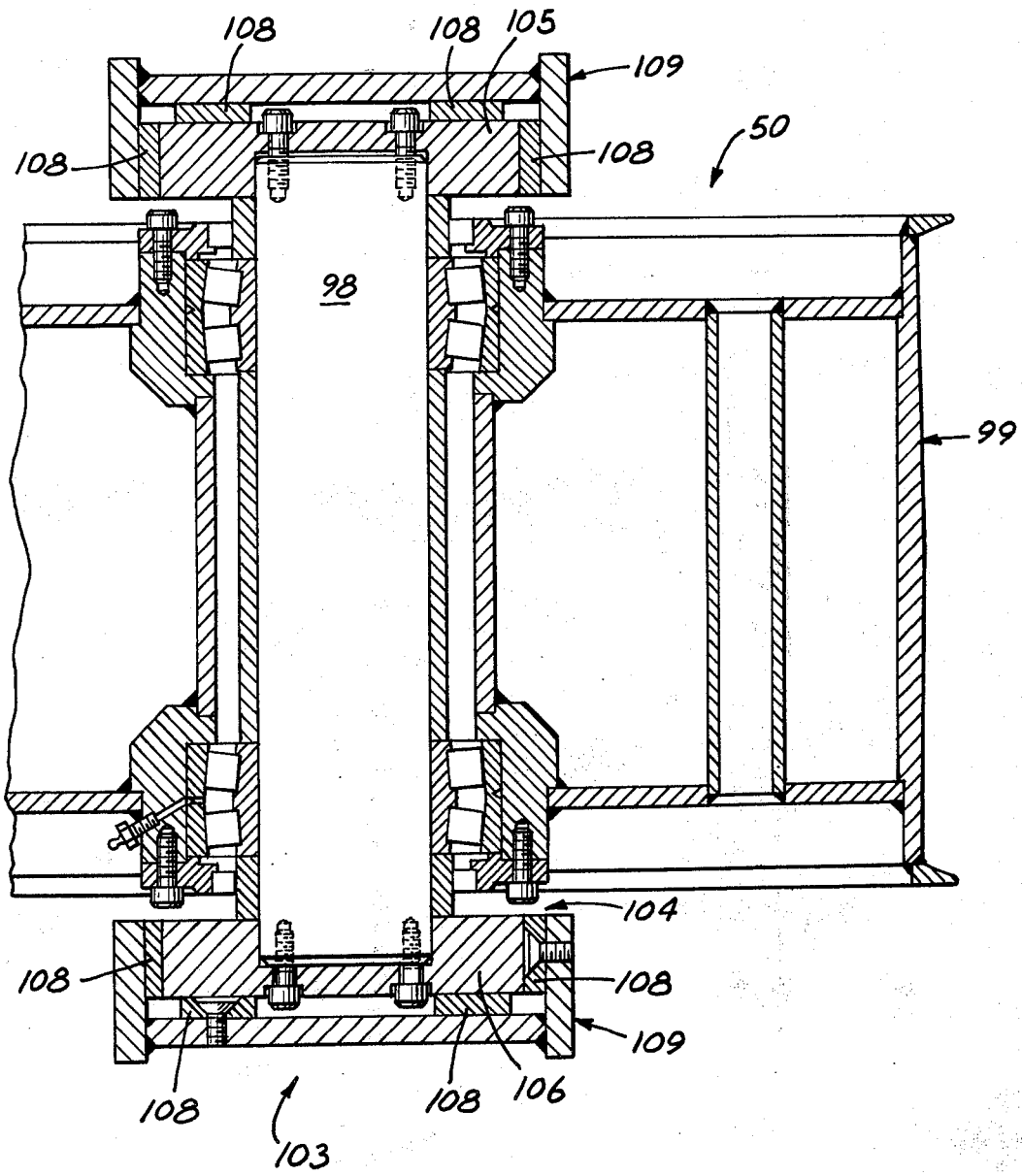
FIG. 7 is an enlarged sectional view taken through the center of a belt tensioning drum.

The belts 46 and 47 are endless and formed of a fixed predetermined length to circumvent the structure 12 and the carriage 19. To provide the desired tightness and thereby the desired normal force on the carriage 19 to hold it against the structural wall, a belt tightening or tensioning means is provided. Herein, the belt tensioning means comprises means for shifting the axis and position of belt drum 50 to vary the distance between its axis of rotation and the axis of rotation of the drum 49 to either reduce or lengthen the belt loop between these belt drums 49 and 50. The drum 50 has a central non-rotatable support shaft 98 (FIG. 7) carrying an outer rotatable ribbed drum structure 99 for rotation about a vertical axis through the shaft 98. The means for shifting the position of the shaft 98 and thereby the axis of the drum 50 comprises a hydraulic cylinder 100 (FIG. 8) fastened to and extending outwardly from one end of a stationary slide frame 103 mounted on the carriage frame. Slidably mounted within the slide frame 103 is a slide means 104 which comprises upper and lower bar slide 105 and 106 to which are secured the upper and lower ends of the drum shaft 98, as best seen in FIG. 7. The slide frame 103 is mounted on and secured to a stationary section 107 (FIG. 8) of the carriage frame.

Figure 8:
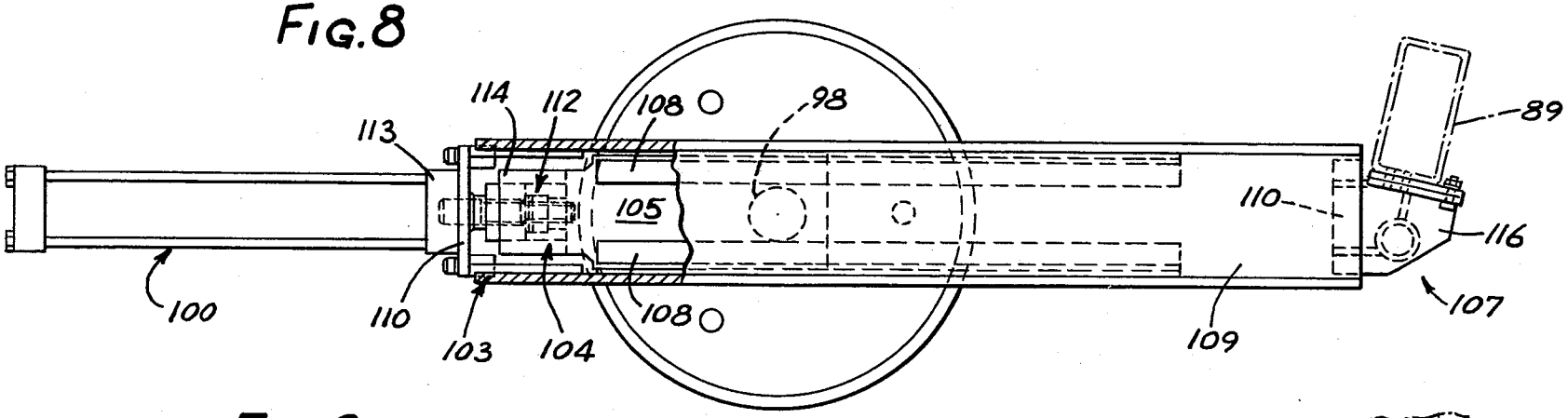
FIG. 8 is a plan view partially in section of the belt tensioning mechanism.
Figure 9:
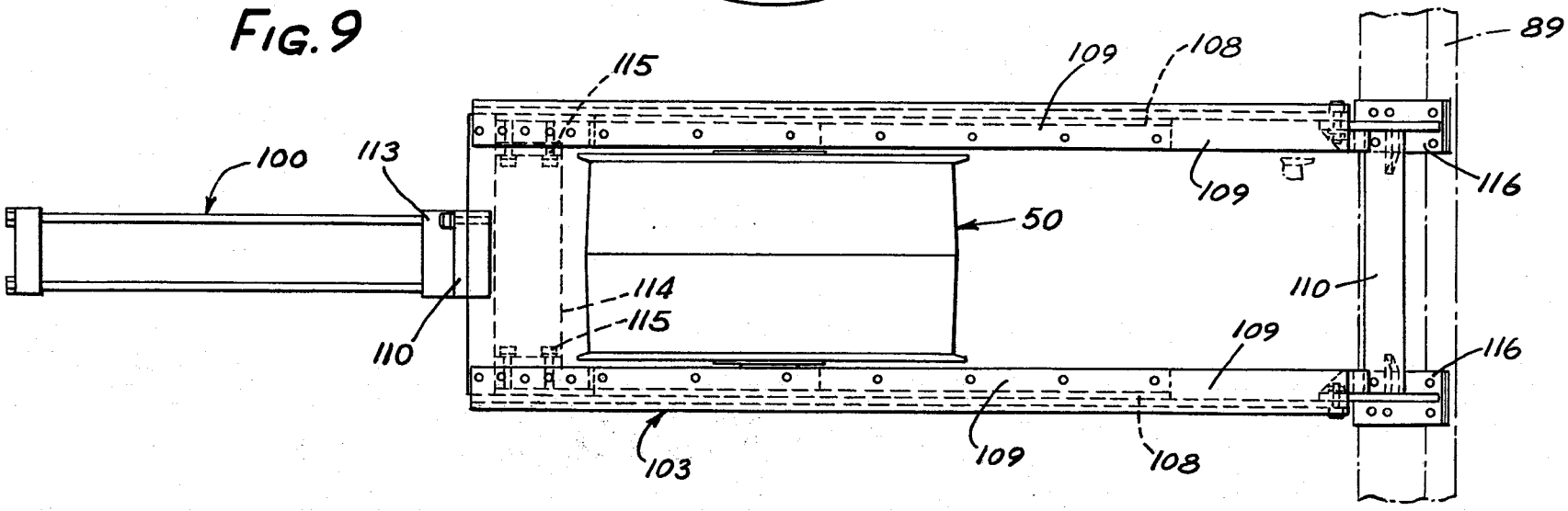
FIG. 9 is an elevational view of the belt tensioning mechanism shown in FIG. 8.

The upper and lower bar slides 105 and 106 are mounted and guided for sliding movement along pairs of horizontal and vertical bearing bars 108, for example, 2 inches wide, 61 inches long, bronze bars in engagement with the outer vertical and horizontal sides of the slides 106. The bars 108 are fastened to and within a pair of upper and lower channels 109 which are spaced vertically from each other and are secured at opposite ends thereof to vertically extending plates 110 to define the slide frame 103, as best seen in FIG. 8. As seen in FIG. 9, the drum 50 is mounted in the space between these upper and lower frame channels 109 to allow horizontal movement thereof when shifting the drum shaft 98. In the preferred embodiment of the invention, the drum shaft 98 may be shifted up to 30 inches to change the length of the belt in the loop between the drums 49 and 50.

As best seen in FIGS. 8 and 9, the hydraulic cylinder 100 is fastened at one end to the slide frame 103 by a mounting block 113. The internal ram (not shown) of the hydraulic cylinder is connected by means 112 to a vertically extending post 114 (FIG. 9) which is fastened by bolts 115 to the slide bars 105 and 106 to push or pull the same with rectilinear travel of the ram. To take the thrust of the hydraulic cylinder 100, the frame section 107 on the carriage preferably includes brackets 116 (FIGS. 8 and 9) fastened to one of the vertical carriage frame posts 89. Thus, in a familiar manner, operation of the hydraulic cylinder 100 moves the slide means 104 to reposition the drum shaft 98 for the drum 50 to various positions to take up or to loosen the tension in the drive belt 46. A similar belt tightening mechanism is provided for the belt 47.

The belt guiding drums 52 and 52*a* may be constructed in a manner similar to the construction above described for the drums 49 and 50. These drums 52 and 52*a* are located centrally of the carriage 19 and generally outward of the tendon tensioning means 27, as best seen in FIGS. 1 and 2. These drums are mounted to turn about vertical axles 116*a* mounted in frame sections 117 (FIG. 3) carried by upstanding posts 118 of the carriage frame.

Turning now to the tendon tensioning means 27 for tensioning the tendon 17, it is preferably that which is fully disclosed in detail in the aforementioned co-pending patent application which is hereby incorporated by reference in its entirety as if fully reproduced herein. Briefly, as disclosed in U.S. Pat. No. 3,687,380 and in the co-pending application, the prestressing unit, as shown in FIG. 4 herein, swings about a vertical axis through an articulating means 29. Also, as fully described in the co-pending application, the prestressing unit 28, which carries the hydraulic motor pumps 120 and 121 at one end, is mounted for turning about a vertical axis through spaced stub shafts 119 and is mounted for slight turning about a horizontal axis at bearing means 123.

As best seen in FIG. 4, the prestressing unit 28 includes a pair of Hagglund hydraulic motor pumps 120 and 121 supported on frame plates 124 of the prestressing unit and carrying internal sprockets 122 which are meshed with the chains 31 which carry the tendon restraining elements through a horizontal path between backup means 125 which press the restraining elements tightly against the tendon which discharges from the prestressing unit 28 at a pair of rollers 126. The backup means pushes the restraining elements so tightly that the tendon does not slip thereon as it is being tightened. The restraining elements can move slightly relative to the chains 31 to accommodate elongation of the tendon as it is tensioned.

The load cell means 35 for measuring the tension in the tendon 17 comprises a pair of load cells 127 (FIG. 4) mounted between the horizontal slidable frame plates 124 of the prestressing unit 28 which move horizontally through and relative to the upstanding carrier 128 which is mounted on the carriage. More specifically, pivotally mounted link units 129 are fastened at their forward ends 130 to the prestressing unit 28 and at their rearward ends to the carrier 128 with the load cells 127 intermediate the ends and in tension to provide an accurate readout of the tension in the tendon.

As fully discussed in the co-pending application and the aforementioned patent, the carrier 128 and tendon tensioning mechanism 28 thereon may be shifted vertically relative to the structural wall and to the carriage 19 by motors 133 (FIG. 3) through a vertical distance of about 5 or 6 feet allowing the unit to band several grooves in the wall before it is necessary to shift the entire carriage vertically. More specifically, the prestressing unit 28 is shiftable vertically on upstanding standards on the carriage frame between the solid line upper position shown in FIG. 3 and the lower dotted line position shown in FIG. 3.

The reel means 25 carrying a large supply of untensioned tendon 17 is lifted and loaded into the carriage by a block and tackle means 135 including lower suspending strands 136 extending downwardly from an overhead pulley block 137 to support a pair of circular discs 138 for the spool around their edges. The pulley block 137 is connected by cables 139 to a pulley 140 which is mounted on a shaft 141 carried by a bracket 142 on the top of the frame of the carriage. The strands 139 extend from the pulley horizontally along the top of the carriage to a motor driven hoist 143 which is mounted in suitable frame supports 144 at the top of the carriage. Operation of the motor driven hoist 143 raises or lowers the block and tackle means 135 and thereby shifts vertically the spool means 25 for loading or unloading the same.

Preferably, the tendon 17 issuing from the spool means must be pulled from the spool against the force of a motor means 145 which exerts a force on the spool means 25 to turn the same to take up and wind the tendon on the spool means. That is, a back tension is applied to the tendon 17. In the case of carriage travel in th reverse direction, the motor means 145 will cause the spool to rewind the cable being taken up onto the spool means.

The tendon 17 discharges at the bottom of the spool means 25 to travel in a horizontal path across to a swiveled sheave 146 mounted on stationary brackets 147 at the bottom of the carriage 19. The tendon then trvels along a straight line upward path to a rotatable guide pulley 148 carried by bracket arms 149 which are fastened at their other ends to the vertically shiftable carrier 128 of the prestressing unit 28. The tendon 17 travels across the top of the pulley 148 to travel forwardly into the center of the prestressing unit 28 for travel between the hydraulic motor pumps 120 and 121 and the frictional restraining elements of the prestressing unit which exert a restraining force on the tendon and thereby tension the tendom extending therefrom to the structural wall.

In accordance with another aspect of the invention, the hydraulic system used for the traction and propelling of the carriage 19 is of the fixed displacement kind which is of particular utility in maintaining the tension more uniformly with variations in travel speed of the carriage; and there is featured a primary drive hydraulic means or system for the belt drive drums **53, 53*a*, 54 and 54*a* operating at high hydraulic pressure and a regenerative drive system which utilizes work performed in tensioning the cable to provide a lower hydraulic pressure power input to the belt drive drums 53, 53*a*, 54 and 54*a*** to propel the carriage, as will be described hereinafter in detail.

Figure 10:
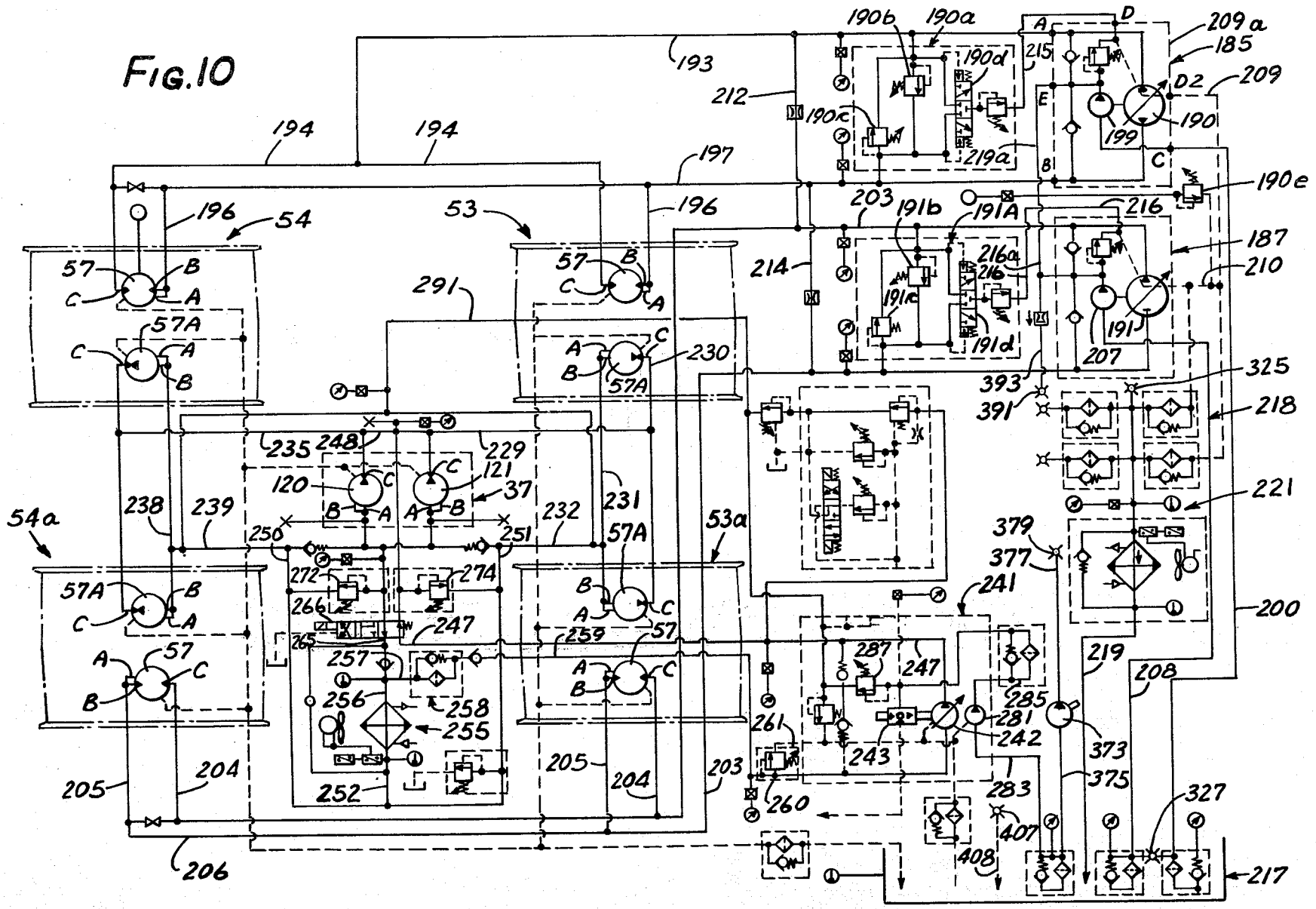
FIG. 10 is a schematic view of a hydraulic circuit for use with the wire winding apparatus shown in FIG. 1.

Referring now to the drawings, and more particularly to the schematic hydraulic circuit shown in FIG. 10, the primary drive system for moving the carriage is a closed loop system which includes a first pump means 185 and a second pump means 187, each indicated by dotted lines in FIG. 10. Each of these pump means includes a high pressure pump 190 and 191, which supply high pressure fluid at about 2,000 p.s.i., as well as associated supercharge pumps 199 and 207, respectively. The first pump means 185 drives the upper set of belt drive drums 53 and 54 for the upper belt and the second pump means 187 drives the lower belt drive drums **53*a* and 54*a***. To assure that the belt drives operate equally, the first and second pump means are hydraulically interconnected by crossover lines therebetween, as will be explained in detail.

The first hydraulic pump 190, when driving in the forward direction, delivers pressurized fluid from its outlet over line 193 and lines 194 to inlets C of the respective motors 57 for each of the upper double pump drive belt drums 53 and 54. When these motors are driven in the forward direction, the fluid flows from their return ports A through lines 196 to a common return line 197, the latter returning the fluid to the primary hydraulic pump 190. Conversely, when the hydraulic pump 190 is being driven in the reverse direction, the fluid will flow through the line 197 to ports B of the motors 57 to enter the respective motors 57 for return flow through the lines 194 and 193.

The illustrated pump means 190 is purchased as a commercially available package having contained therein a supercharge pump 199 which supplies makeup hydraulic fluid to the pump 190 that the supercharge pump obtains over a line 200 extending to a common hydraulic reservoir 217. The second hydraulic pump 191 of the primary hydraulic system operates in a similar manner to he first hydraulic pump 190 in that its outlet is connected to a line 203 which is common to the inlet lines 204 connected to ports C of the hydraulic motors 57 for the lower double drive belt drums **53*a* and 54*a*. From the motors 53*a* and 54*a*, the hydraulic fluid leaves via ports A to flow through lines 205 which are connected to a common return line 206 which returns to the inlet side of the primary hydraulic pump 191. When driving in the reverse direction, hydraulic fluid is pumped through line 206 to ports B of the hydraulic motors 57 and returns over lines 204 and 203. A supercharge pump 207 is connected to the primary pump 191 and comes as part of the commercial package constituting the pump means 187. The supercharge pump 207 receives makeup fluid from the hydraulic reservoir 217 over a line 208.**

The preferred hydraulic pump means 185 and 187 are Sunstrand 27 Series pumps operable at 1800 r.p.m., 158 g.p.m. and 1300 to 2000 p.s.i. These pumps are manually adjustable as indicated by the arrow conrols thereon and thereby it is possible to adjust and control the speed and direction of the movement of the carriage 19. This adjustment and control constitutes, in a sense, a hydraulic transmission for propelling the carriage 19 about the structural wall. Th several conventional valves associated with these respective pump means will not be described in detail herein.

It is important to provide means for assuring that the upper belt drive drums 53 and 54 and the lower belt drive drums 53*a* and 54*a* receive substantially the same torque and are driven in synchronism without gear boxes and without slippage between drums to keep the carriage 19 moving forwardly without creating twisting moments on the belts 46 and 47. To this end, the hydraulic motors 57 for the upper belt drive drums 53 and 54 are hydraulically interconnected with the hydraulic motors 57 for the lower drums 54*a* and 53*a* by cross flow fluid lines 212 and 214. The cross flow line 212 connects supply line 193 of the first pump 190 with supply line 203 of the second pump 191. Likewise, their return lines are interconnected with the return line 197 for the first pump 190 being connected by a cross flow line 214 to the return flow line 206 for the second pump 191.

For the purpose of filtering and cooling the hydraulic fluid circulated by these primary system pumps 190 and 191, drain lines 109 and 210 extend from these pumps to a conventional filter 218; and the filtered fluid discharges from the filter 218 via a line 211 to a conventional Hyden heat exchanger 221 from which the cooled and filtered hydraulic fluid is discharged via a line 219 to the common hydraulic fluid reservoir 217. Because the filter 218 and heat exchanger 221 are conventional and commercially available units, they will not be described in detail herein. Each of the primary hydraulic pumps 190 and 191 are provided with motor control valve means 190*a* 191*a* between their respective high pressure outlet lines 193, 203 and their respective return lines 197, 106. The motor control valve means 190*a* comprises a first relief valve 190*b* and a second relief valve 190*c* connected across the lines 193 and 197 to provide relief of the supercharge flow. A shuttle valve 190*d* controls the charge relief flow direction. A line 215 connects the shuttle valve 190*d* to drain lines 209 and 209*a*. A similar motor valve arrangement 191*a* is used for the pump 191 and hence a separate explanation therefor need not be given. A separate relief line 216 connects the motor valve 191*a* to drain line 210. Another neutral relief valve 190*e* is connected to lines 215*a* and 216*a* and operates when the belt drive drums and their pumps 190 and 191 are in neutral to allow the fluid to flow through the valve 190*e* and drain line 210 to the reservoir 217.

The regenerative system includes the hydraulic pump means 37 comprising the motor pumps 120 and 121 (FIG. 10) and it is used to supply power to the motors 57*a* for each of the respective belt drive drums 54, 54*a*, 53, 53*a*. More specifically, the tension head hydraulic motor pumps 120 and 121 are driven by the tendon 17 when the carriage 19 is moving and the tendon is being restrained to cause fluid under pressure to flow from these motor pumps 120 and 121 to the motors 57*a* for the belt drive drums. As will be explained, the preferred regenerative system is a closed loop system of the fixed displacement and of the variable pressure type.

Turning in greater detail to the system shown in FIG. 10, the pump 121 is connected by a line 229 to a common inlet line 230 leading to inlet ports C of the respective hydraulic drum motors 57*a* for the belt drive drums 53 and 54. Outlet ports A from these respective motors 57*a* are connected to a return line 231 which in turn is connected to the line 232 to return fluid at low pressure, for example, 200 to 250 p.s.i., through a line 233 extending to inlet port A for the motor pump 121. In a similar manner, the outlet port C for the hydraulic motor pump 120 is connected via a line 235 to the inlet ports C for the respective drum motor 57*a* for the belt drive drums 53 and 53*a*. Outlet port A of these motors is connected to lines 238 which in turn are connected to a common return line 239 extending to return the low pressure hydraulic fluid to a line 240 connected to return to port A for the tensioning head motor pump 120. Herein, each of the motor pumps 120 and 121, which are Hagglund hydraulic motors, Series 4160, are driven at twice the r.p.m. of the motors 57*a* for the belt drive drums so that each single motor pump may supply twice the volume of fluid flow for dividing between its associated pair of motors 57*a*. Thus, it will be seen that the tensioning head motor pumps 120 and 121 are hydraulically connected directly to and provide a power input to all the belt drive drums 53, 53*a*, 54 and 54*a*. As the regenerative hydraulic system is connected to each of these belt drive drums, there should be no uneven force distribution therebetween because of the regenerative system.

For the purpose of conrolling the tension of the tendon 17 directly and to vary the fluid pressure in the closed loop regenerative system, an electrically conrolled variable pump means 241, as indicated in dotted lines in FIG. 10, is provided with a variable pressure pump 242 which is controlled by an electrical valve 243 which in turn is directly controlled by a tension control means including the load cell means 35 monitoring the tendon tension as described in detail in the aforementioned patent and co-pending patent application. In this instance, the electrically operated valve 243 is connected to a swash plate 245 in the pump 242 to control in a known and conventional manner the pressure and flow rate of fluid from the pump 242 outwardly over a line 247 which extends to a pair of connected branch lines 248 extending to the high pressure side of the output lines 229 and 235 from the respective regenerative motor pumps 120 and 121. Preferably, the illustrated variable pressure pump 242 is a 79 g.p.m. pump made by Dension Series 46, which, as will be explained in detail hereinafter, supplies about 28 g.p.m. of makeup fluid to compensate for cross port leakage in the regenerative system loops having the respective motor pumps 120, 121 and drum motors 57*a*.

For the purpose of filtering and cooling the hydraulic fluid in the regenerative loops, some of the hydraulic fluid returning from the motors 57*a* of the belt drive drums and flowing through return lines 232 and 239 is diverted through lines 250 and 251 to a common line 252 entering a Hyden heat exchange means 255. The cooled fluid flows out from the heat exchanger 255 over line 256 to an inlet line 257 to a conventional filter means 258. This filtered fluid returns over a line 259 through a valve 260 and a line 261 to the pump 242. The output line 256 from the heat exchanger means 255 is also connected to a line 265 which flows to a directional valve 266. A pair of safety valves 272 and 274 are connected to he directional valve 266 and are likewise connected by lines to the respective diverting lines 250 and 251. More specifically, the relief valve 274 is a 3000 p.s.i. relief valve connected to the high pressure fluid line 247 from the pump 245 and if the pressure in the line 247 exceeds 3000 p.s.i. the relief valve 274 will open and allow fluid to flow therethrough over line 276 to the low pressure line 251 thereby avoiding damage and further pressure buildup in the line 247.

The preferred motor means 241 also includes as part of the conventional Denison series 46 pump package a supercharge pump 281 for supplying makeup fluid from the common reservoir 217. More specifically, the supercharge pump 281 is connected by a line 283 to the common fluid reservoir 217 and its output is connected to a line 285 leading to a valve 287 which is part of the motor control and connected suitably to the return lines for the pump 242. The valve 287 is also connected to a back pressure line 291 extending from the return lines 232 and 239 of the motor pumps 120 and 121 to apply back pressure to the denison motor control unit 241. Herein, the back pressure is usually 250–350 p.s.i.

Figure 11:
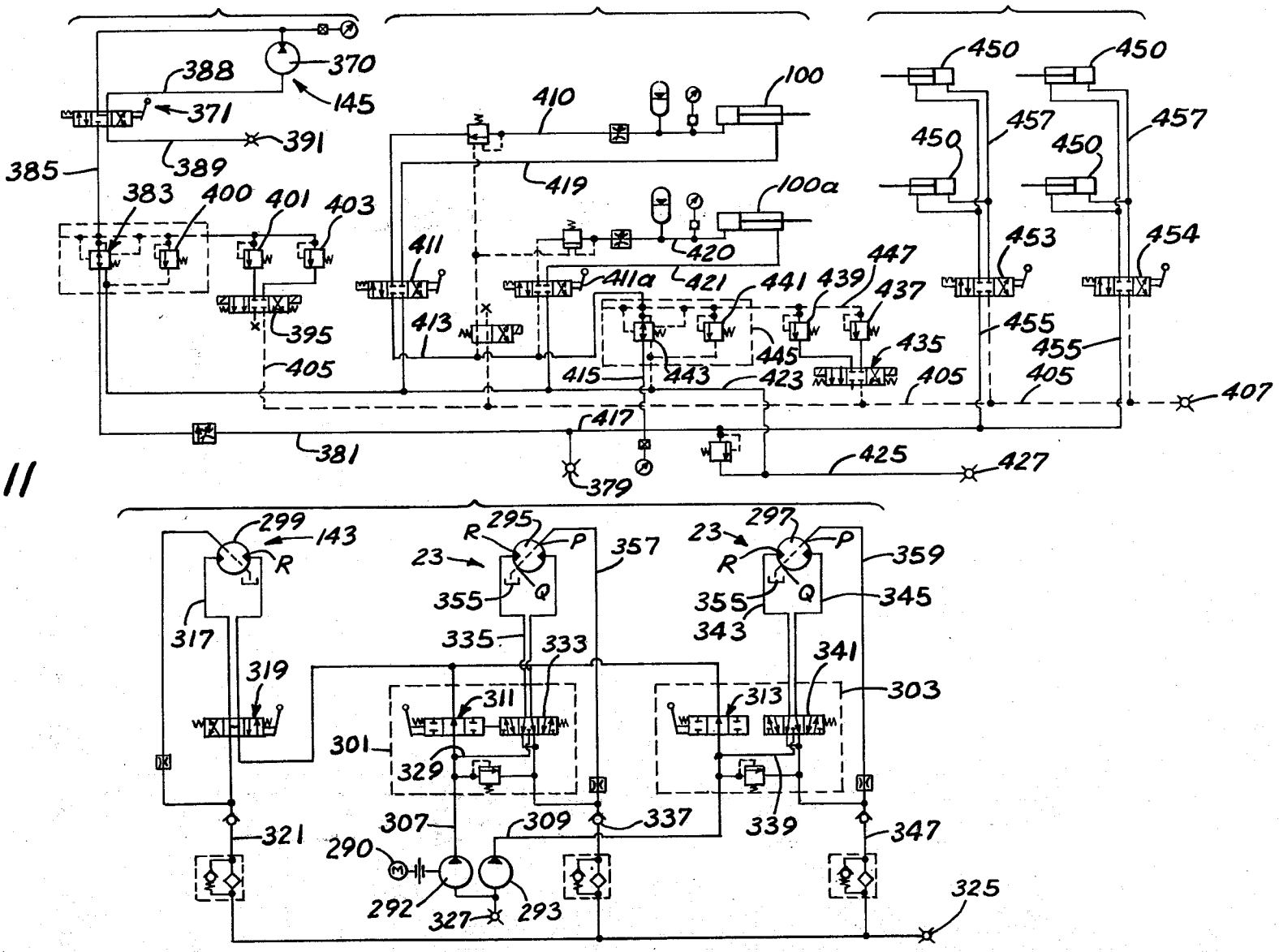
FIG. 11 is a schematic hydraulic circuit for use with the hydraulic circuit of FIG. 10.

The hoist means 20 for shifting the carriage vertically comprises the hydraulic powered hoist units 23 above-described which are also connected to the hydraulic circuits shown in FIGS. 10 and 11. To provide for the large, vertical movement of the carriage, in this instance, 100 feet, it is preferred to mount an additional motor 290 on the carriage for driving a separate pair of dual hydraulic pumps 292 and 293 which provide the hydraulic fluid for operating hydraulic hoist motors 295 and 297 for the respective hydraulic hoist units 23. As will be explained in greater detail hereinafter, the pumps 292 and 293 also provide driving hydraulic fluid for a hydraulic motor 299 of the hoist unit 143 which is used to raise and lower the tendon carrying reel means 25 to and from the carriage 19. The preferred motor 290 is a 50 horsepower motor and preferred pumps 292 and 293 supply about 31 g.p.m. each.

The motors 295 and 297 of the hoist units 23 are inactive during the tendon stressing operation with these manual control valves 301 and 303 disposed at the positions indicated in FIG. 11. Fluid is pumped from the respective pumps 292 and 293 over lines 307 and 309 to flow through the center position of the directional valves 311 and 313, respectively, to a common line 315 extending to port R of the reel hoist motor 299 for return flow through a line 317 through the center position of a hoist motor control valve 319 to a line 321 which extends to point 325 in FIG. 11 which is connected to a similarly numbered point 325 in FIG. 10 at the inlet to the main hydraulic system filters 218. Thus, this fluid merely circulates through the filters 218 and heat exchanger 221 and flows over line 219 to the common reservoir 217. Hydraulic fluid from the common reservoir flows through a line 326 (FIG. 10) to a point 327 which is connected to point 327 (FIG. 11) at the inlet sides of the dual pumps 292 and 293. Thus, when none of the manually operated valves 311, 313 or 319 are operated, the respective pumps 292 and 293 merely circulate the hydraulic fluid from the reservoir 217 through the hoist motor 299 to the point 325 for return to the common reservoir 217.

To shift the carriage 19 vertically by the hoist units 23, the valve 311 is operated manually causing the valve 311 to shift and block flow therethrough whereby this hydraulic fluid flows over line 329 and upwardly through the directional valve 333 and line 335 to port R of hoist hydraulic motor 295 for return flow over line 337 to the point 325 which, as above described, is connected to the heat exchangers and filters which will not be receiving heated fluid from the motor 295. In a generally similar manner, manual operation of the valve 313 blocks fluid flow therethrough and causes fluid flowing over line 309 to flow through line 339 and directional valve 341 upwardly through the line 343 to port R of the hydraulic motor 297 for flow thereto to return at the low pressure side to a line 345 through the valve 341 to a line 347 connected to the point 325 for flow through the heat exchanger and filters shown in FIG. 10. When the hoist motors 295 and 297 are not in operation, suction filters 355, diagrammatically illustrated in FIG. 11, connected to reservoir 217 are connected across ports Q and P for the motors 297 for a small fluid flow therethrough with the fluid returning over lines 357 and 359, respectively, to the common reservoir 217.

It will be recalled that the spool means 25 carrying the tendon 17 has a motor means 145 applying a back tension to tendon 17. This motor means 145 is shown in FIG. 11 as comprising a hydraulic motor 370 controlled by a manually operated valve 371. The fluid under pressure for the hydraulic motor 370 for the reel supply means 25 is provided by a separate pump 373 (FIG. 10) which, in this instance, is a 24 g.p.m. pump connected by a line 375 leading to the hydraulic reservoir 217. The output line 377 from this pump 373 extends to a point 379 in FIG. 10 which is connected to point 379 in FIG. 11 leading to a line 381 extending through a first high pressure valve 383 to a line 385 to the directional control valve 371 for flow therethrough to the hydraulic motor 370 for return over a line 387 and the valve 371 to a line 389 extending to a point 391 (FIG. 11) which is connected to a similarly numbered point 391 is also shown in FIG. 10 as being connected to a line 393 extending to the respective supercharge pumps 199 and 207.

The force provided by the motor 370 is varied depending upon the amount of tendon on the reel means 25 to keep a more uniform tension on the tendon between a full and almost empty reel. Also, greater force is applied by the motor 370 to rewind tendon onto the reel than to merely tension the tendon.

The facilitate providing various levels of tension on the tendon at the spool means 25, a solenoid control valve 395 is provided adjacent the valve 383 and two separate flow control valves are controlled thereby, namely, a medium pressure valve 401 and a low pressure valve 403. A third valve 400 for high pressure is provided with the valve 383. The directional control valve 395 is connected by a line 405 to a point 407 (FIG. 11) which is connected to point 407 (FIG. 10) directly abovea line 408 leading to the common reservoir 217 for return of fluid to the reservoir. A line 423 also extends to the valve 383 and it is connected to a return line 425 and to point 427 (FIGS. 10 and 11) which lead to the filters 218, heat exchanger 221 and common reservoir 217. By appropriate setting of the solenoid control valve 395 and the valve 383 the amount of tension can be controlled depending on which of the three valves 400, 401 or 403 is operated.

It will be recalled that the belt tensioning mechanism for tensioning the belts 46 and 47 at the rear of the carriage included the movable belt drums 50 and 50*a* which are shifted by hydraulic cylinders 100 and 100*a*. These cylinders are shown in FIG. 11 as being connected by a line 410 to a manually operable directional valve 411 and then lines 413, 415 and 417 to the point 379 (FIGS. 11 and 10) which is connected to the 24 g.p.m. pump 373 shown in FIG. 10. In a similar manner, this pump 373 supplies fluid for the hydraulic cylinder 100*a* upon operation of a manually controlled valve 411*a* over lines 417, 415, 416, valve 411*a* and line 420. Fluid returns to the common reservoir 217 from the cylinders 100 and 100*a* over lines 419 and 421 to a common return line 423 connected to a line 425 extending to point 427, FIG. 11, the point 427 being shown in FIG. 10 as connected to the input side of the filters 218 and heat exchangers 221 for returning fluid over line 219.

To provide three levels of force application by the rams of the hydraulic cylinders 100 and 100*a*, there is provided a directional valve 435, which is connected through a low pressure valve 437, a medium pressure valve 439 and a high pressure valve 441 to the output line 405 connected at point 407 to return to the common reservoir 217 in the manner above explained. A further flow control valve 443 is provided in the valve means 445 and it is connected in the line 415 of high pressure fluid to the cylinders and is connected by a line 447 to the flow control valves 441, 439, 437 and the directional valve 435 for returing low pressure fluid over line 405, point 407 and line 408 to the common reservoir 217.

Before the carriage 19 is moved vertically relative to the wall 12 with its vessel, the wheels 45 are shifted outwardly from engaging with the wall by operation of hydraulic jacks 450 (FIGS. 2 and 11) which are extended first to engage the wall and thereafter to force the carriage radially outwardly of the wall. As best seen in FIG. 11, the four hydraulic jacks 450 each have a hydraulic cylinder, pair of the hydraulic cylinders being controlled by directional control valves 453 and 454. The high pressure fluid is directed to the directional valves 453 and 454 over lines 455 which extend to the line 417 and point 379 (FIGS. 10 and 11) connected to the pump 373, (FIG. 10). Low pressure fluid returns from the hydaulic jack cylinders 450 over lines 457 to the directional valves 453 and 454 and from the latter over line 405 to point 407 (FIGS. 10 and 11) for return to the common reservoir 217.

A brief review of the operation of the apparatus will be given as an aid to understanding the same. The carriage 19 is suspended by a suspension system 20 along the vertical side of the vessel wall 12 with the non-driven wheels 45 of the carriage in rolling engagement with the wall. The suspension system comprises the overhead track 21 with a pair of trolley units 22 from which depend the supporting cables 24 which are wound on hoist units 23 on the carriage 19. The hoist units 23 have hydraulic motors 295 and 297 (FIG. 11) which are driven by the dual hydraulic pumps 291 and 293 which, in turn, are driven by the separate electric motor 290 on the carriage. By operating the directional control valves 311 and 313 individually, the hoist hydraulic motors 295 and 297 may either wind or unwind the suspension cables 24 to raise or lower the carriage to the desired position. During the raising or lowering of the carriage 19, the hydraulic jacks 450 will have been operated to extend the vessel wall to shift the carriage 19 radially outward to the carriage wall 12 to space the wheels 45 in contact therewith. With the carriage 19 at the proper vertical height, the valves 453 and 454 (FIG. 11) are reversed to retract the hydraulic jacks 450 thereby allowing the wheels 45 to contact the wall 12 for rolling engagement therewith in the circumferential direction.

The belts 46 and 47 are then properly tensioned by operation of the belt tensioning means at the rear of the carriage which shifts the belt drums 50 and 50*a* relative to the drums 49 and 49*a* to provide the desired belt tension for forcing the wheels 45 to contact the wall of the vessel with the desired normal force and to assure that the belts will not slip relative to the belt drive drums 53, 54, 53*a* and 59*a*. The belt drums 50 and 50*a* are carried by the slide means 104 and 104*a* which are shiftable by the hydraulic cylinders 100 and 100*a* upon operation of the directional valves 411 and 411*a* (FIG. 11).

With the belts 46 and 47 properly tensioned, the carriage is propelled in the forward direction to pay out the tensioning of the tendon by operation of the belt drive drums 53 and 54 and 53*a*, 54*a*, at the front of the carriage to drive the belts 46 and 47 toward the rear of the carriage from which the belts discharge to the wall 12. The drive belt drums 53, 53*a*, 54 and 54*a* each include the pair of internal hydraulic motors 57 and 57*a*, (FIG. 5), about which are secured the belt drum rims 59 to provide a direct drive for the belt wrapped thereabout. The preferred belts 46 and 47 are about 16 inches in width and are comprised of 24 5/16 inch diameter steel cables covered by fabric and an outer elastomeric or rubber, tire-like material for frictional engagement with the vessel wall 12 and with the rims 59 on the driving drums. As best seen in FIG. 10, the belt driving drums 53 and 54 are connected to and driven by the primary hydraulic pump 190 and its supercharger pump 199, which are suitably driven by motors (not shown). In a like manner, the hydraulic motors 57 for the lower belt drive drums 53*a* and 54*a* are connected to and driven by a similar primary hydraulic pump 191 and its supercharger pump 207. The load is shared between the upper and lower sets of belt drive drums 53, 54 and 53*a* and 54*a* hydraulically thus eliminating the shafts and chains used for this purpose in the aforementioned patent application.

Specifically, the crossover hydraulic line 212 connects the high pressure lines 193 and 203 from the respective primary pumps 190 and 191 and the crossover line 214 connects their respective return lines 197 and 206. Thus, torque between the four drums is shared and the usual problems with mechanical arrangements for interconnecting a series of traction means have been eliminated.

The regenerative hydraulic pump means 37 includes the hydraulic pumps 120 and 121 which are operated by tendon 17 turning the endless chains 31 (FIG. 4) and their sprockets 122 to pump fluid from these regenerative pumps 120 and 121 over the lines 229 and 235 (FIG. 10) to the regenerative hydraulic motors 57*a* within each of the belt drive drums 53, 54, 53*a* and 54*a*. The belt drum rim 59 for each of these belt drive drums assures that the regenerative motors 57*a* are mechanically interconnected with the other motors 57.

The tension in the tendon 17 is monitored by the load cell means 35 which comprises load cells 127 (FIG. 4) mounted between the carrier 128 and the prestressing unit 28 which is mounted for movement with the tendon relative to the carrier. The load cell means 35 is connected to and is controlled by an electrically operated solenoid 243 (FIG. 10) for operating a swash plate 245 of the regenerative variable pressure pump 242 and its supercharger pump 281. The pump 242 is connected by a line 247 to the pumps 120 and 121 and thus controls the resistance of the regenerative pumps 120 and 121 to being turned by the tendon and this provides a more uniform tensioning for the tendom 17.

The tendon prestressing unit 28 may turn about a vertical axis through the stub shafts 119, as shown in FIG. 2, to maintain a straight path of travel for the tendon as it was being stressed and traveling to the wall 12. A bearing means 123 also allows the restressing unit 28 to pivot about a horizontal axis to prevent bending of the tendon as it discharges from rollers 126 at the end of the prestressing unit 28.

The tendon tensioning mechanism 27 is movable vertically on the carriage for a distance of 5 or 6 feet between the solid line and dotted line position shown in FIG. 3 upon operation of motors 133 connected to jack screws (not shown) similar to those disclosed in the aforementioned patent for shifting the tendon tensioning mechanism.

From the foregoing, it will be seen that there is provided a method of tensioning a tendon 17 and banding a circumferentially extending wall 12 of a structure by a tendon tensioning mechanism 27 carried on a movable carriage 19 comprising the steps of: traveling the carriage 19 circumferentially about the wall 12 of the structure, tensioning a portion of the tendon within the tendon tensioning mechanism 27, paying out the tensioning tendon from the tendon tensioning mechanism to the structural wall along a tenagential path from the tendon tensioning mechanism to the circumferential wall, suspending the carriage on the structure and urging the carriage against the structural wall, positioning a belt means 41 circumferentially about the structural wall and propelling the carriage forwardly by pulling or passing the belt means 41 through a belt drive means 42 which returns the belt means 41 to the wall as the carriage 19 travels forwardly and the tensioned tendon is wrapped about the structure. In this method, the propulsion is achieved by a pulling force on the belts 46 and 47 rather than exerting a high driving torque on rotating tires or caterpillar tracks as in the other devices used for tensioning tendons of this type.

While the belts 46 and 47 are above described as being very wide and flat, it is to be appreciated that the belts may be formed with other shapes and cross sections and that the means on the carriage for engaging the belt means may take other forms than the illustrated belt drums. The tendons 17 likewise may be flat in cross section or have other shapes and sizes. For instance, the belts may be circular in cross section as are the illustrated tendons 17 and the belt drive means 42 may be in the form of pairs of endless restraining bands for gripping opposite sides of belts in a manner similar to that used in the tendon tensioning mechanism 27.

Accordingly, it will be seen from the foregoing that the above described method and apparatus is capable of banding large structures at a reasonable cost and in a reasonable time and that the apparatus will reduce the stoppages and downtimes for repairs and maintenance heretofore experienced, particularly within such a rigorous and demanding environment of large, rough-surfaced cylindrical upright walls with highly tensioned, large-sized steel tendons.

While a preferred embodiment has been shown and described, it will be understood that there is no intent to limit the invention by such disclosure but, rather, it is intended to cover all modifications and alternate constructions falling within the spirit and scope of the invention as defined in the appended claims.

I claim:

1. A wire winding apparatus for banding a wall of a structure with a tensioned tendon comprising:
   - a carriage movable about the structural wall to apply a tensioned tendon to the structural wall,
   - means on said carriage for tensioning the tendon and for paying out the tendon to the structural wall,
   - belt means encircling said structural wall and in frictional engagment with a substantial peripheral portion of said structural wall,
   - means on said carriage for engaging said belt means and pulling thereon with sufficient force to propel said carriage circumferentially about said wall, and
   - said belt means comprising an upper belt extending about an upper portion of said carriage and a lower belt extending about a lower portion of said carriage, said belts being spaced vertically from each other and extending circumferentially about said structure.

2. A wire winding apparatus in accordance with claim 1 in which said upper and lower belts are flat, wide belts formed of steel cables, said belts having an outer elastomeric covering thereon for engaging the structural wall.

3. A wire winding apparatus in accordance with claim 1 in which said means on said carriage for engaging said belt means and pulling thereon with sufficient force to propel said carriage comprises a hydraulic motor drive means and a belt drive drum means in engagement with said belt means and driven by said hydraulic motor drive means.

4. A wire winding apparatus in accordance with claim 3 in which said hydraulic motor drive means includes a regenerative hydraulic system connected to said means on said carriage for tensioning the tendon and receiving a work input during the tensioning of the tendon, said hydraulic motor drive means also including a primary hydraulic drive system, said belt drive drum means including a plurality of drive belt drums and a pair of hydraulic motors for each of said belt drive drum means, one of said pair of hydraulic motors being connected to and driven by said regenerative hydraulic system and the other one of said hydraulic motors connected to and driven by said primary hydraulic system.

5. A wire winding apparatus in accordance with Claim 4 in which each of said pairs of hydraulic motors are coaxially mounted adjacent one another, and a belt engaging rim on said belt drive drum means is fastened to each of said pair of motors to be directly driven thereby.

6. A wire winding apparatus in accordance with claim 4 in which said belt comprises an upper belt and a lower belt and in which first and second drive belt drums are provided for each of said upper and lower belts adjacent the forward end of the carriage.

7. A wire winding apparatus for banding a wall of a structure with a tensioned tendon comprising:

a carriage movable about the structural wall to apply a tensioned tendon to the structural wall, means on said carriage for tensioning the tendon and for paying out the tendon to the structural wall, belt means encircling said structural wall and in frictional engagement with a substantial peripheral portion of said structural wall, means on said carriage for engaging said belt means and pulling thereon with sufficient force to propel said carriage circumferentially about said wall, and said belt means comprising an upper and lower belt for circumferentially restraining and urging said carriage against the wall of said structure, and slack takeup means for tightening or loosening said upper and lower belts to provide a predetermined normal force for urging the carriage against the structural wall.

8. A wire winding apparatus for banding a wall of a structure with a tensioned tendon comprising:

a carriage movable about the structural wall to apply a tensioned tendon to the structural wall, wheels on said carriage for rolling engagement with and along said structural wall, tendon tensioning means on said carriage for tensioning the tendon and for paying out the tensioned tendon to the structural wall, an upper belt and a lower belt encircling said structural wall and in frictional engagement with a substantial peripheral portion of said structural wall, belt tensioning means on said carriage co-operating with said belts and said carriage to force said carriage wheels against said structural wall with a predetermined normal force, and an upper belt drive means and a lower belt drive means on said carriage for engaging respectively the upper and lower belts and for pulling thereon to propel said carriage circumferentially about the wall while tensioning the tendon.

9. A wire winding apparatus in accordance with claim 8 in which said upper belt drive means and said lower belt drive means include a regenerative hydraulic system having a hydraulic pump means operable by said tendon tensioning means and having hydraulic regenerative motors driven by the fluid output from said hydraulic pump means.

10. A wire winding apparatus in accordance with claim 9 in which said upper belt drive means comprises first and second belt drive drums having a portion of the upper belt wrapped thereabout, said lower belt drive means comprises first and second belt drive drums having a portion of the lower belt wrapped thereabout, a primary hydraulic system providing the primary drive to said belt drive drums to propel the carriage and tension the tendon, and each of said belt drive drums also being driven by one of said hydraulic regenerative motors.

11. A wire winding apparatus in accordance with claim 9 in which each of said upper and lower belt drive means comprises first and second belt drive drums comprising superimposed hydraulic motors, one of said motors being connected to said regenerative hydraulic system and the other of said hydraulic motors being connected to a primary hydraulic system, and in which a belt engaging rim means on said belt drive drums encircles said motors and is directly fastened thereto to be driven directly by said motors.

12. A wire winding apparatus for banding a wall of a structure with a tensioned tendon comprising:

a carriage movable about the structural wall to apply a tensioned tendon to the structural wall, wheels on said carriage for rolling about said structural wall, means on said carriage for tensioning the tendon and for paying out the tensioned tendon to the structural wall, an upper and a lower flat, wide metallic belt having an outer elastomeric covering thereon for engaging the structural wall, each of said belts encircling said structural wall and in frictional engagement with a substantial peripheral portion of said structural wall and extending about said carriage, a plurality of belt drums on the rear of said carriage with the respective upper and lower belts wrapped thereabout to apply a normal force to said belt drums and thereby to said wheels for said carriage, central belt drums centrally located on said carriage for engagement by said upper and lower belts for circumferentially restraining said carriage adjacent to said structural wall, and at least two belt drive drums for each of said upper and lower belts located at the forward end of said carriage for pulling and driving on said belts to propel said carriage circumferentially about the structural wall while tensioning the tendon.

13. A wire winding apparatus in accordance with claim 12 in which said belt drive drums each comprises a pair of hydraulic motors mounted coaxially and adjacent each other and a belt engaging rim means encircling said hydraulic motors and fastened thereto to be directly driven by said motors.

14. A wire winding apparatus in accordance with claim 11 comprising belt tensioning means on said carriage for tensioning the belts to a predetermined tension.

15. A method of tensioning a tendon and banding a circumferentially extending wall of a structure with the tensioned tendon by a tendon tensioning mechanism on a movable carriage, said method comprising the steps of: traveling the carriage circumferentially about the wall of the structure, tensioning a portion of the tendon within said tendon tensioning mechanism, paying out the tensioned tendon to the structural wall along a tangential path from the tendon tensioning mechanism to the circumferential wall, suspending said carriage on said structure and urging said carriage against the structural wall, positioning a belt means circumferentially about the structural wall, propelling the carriage forwardly by pulling on and passing the belt means through a belt drive drum means on the carriage which returns the belt means to the wall as the carriage travels forwardly, lifting the belt means from the wall adjacent a forward end of the carriage and traveling the belt means along the length of the carriage to a rearward portion of the carriage and then returning the belt means to the wall of the structure, and adjusting the tension in the belt means at the rearward end of the carriage to urge the rear portion of the carriage against the circumferential wall with a predetermined force.

16. A method of tensioning a tendon and banding a circumferentially extending wall of a structure with the tensioned tendon by a tendon tensioning mechanism carried on a movable carriage, said method comprising the steps of: traveling the carriage circumferentially about the wall of the structure, tensioning a portion of the tendon within said tendon tensioning mechanism, paying out the tensioned tendon to the structural wall along a tangential path from the tendon tensioning mechanism to the circumferential wall, suspending said carriage on said structure and urging said carriage against the structural wall, positioning a belt means circumferentially about the structural wall, propelling the carriage forwardly by pulling on and passing the belt means through a belt drive drum means on the carriage which returns the belt means to the wall as the carriage travels forwardly, and generating a hydraulic work force by the tendon tensioning mechanism and using this hydraulic work force to assist in turning the belt drive drum means in propelling the carriage.

17. A method of tensioning a tendon and banding a circumferentially extending wall of a structure with the tensioned tendon by a tendon tensioning mechanism carried on a movable carriage, said method comprising the steps of: traveling the carriage circumferentially about the wall of the structure, tensioning a portion of the tendon within said tendon tensioning mechanism, paying out the tensioned tendon to the structural wall along a tangential path from the tendon tensioning mechanism to the circumferential wall, suspending said carriage on said structure and urging said carriage against the structural wall, positioning a belt means circumferentially about the structural wall, propelling the carriage forwardly by pulling on and passing the belt means through a belt drive drum means on the carriage which returns the belt means to the wall as the carriage travels forwardly, said belt means comprising an upper and lower belt, the propelling of the carriage including the pulling on and the passing of each of the belts individually through a separate belt drive drum means.

* * * * *

UNITED STATES PATENT AND TRADEMARK OFFICE

CERTIFICATE OF CORRECTION

PATENT NO. : 4,002,304

DATED : January 11, 1977

INVENTOR(S) : Endre F. Peszeszer

It is certified that error appears in the above-identified patent and that said Letters Patent are hereby corrected as shown below:

| | |
|---|---|
| Col. 1, line 44 | "of" should be --and--. |
| Col. 2, line 20 | "of" should be --on--. |
| Col. 3, line 27 | "whih" should be --which--. |
| Col. 3, line 34 | "is" should be --in--. |
| Col. 3, line 61 | "torque applied" should be --torque being applied--. |
| Col. 5, line 19 | "in greater to" should be --in greater detail to--. |
| Col. 5, line 22 | "46a are spaced" should be --46a spaced--. |
| Col. 5, line 66 | "alos" should be --also--. |
| Col. 6, line 33 | "capterpillar" should be --Caterpillar--. |
| Col. 9, line 63 | "th" should be --the--. |
| Col. 10, line 2 | "trvels" should be --travels--. |
| Col. 10, line 11 | "tendom" should be --tendon--. |
| Col. 10, line 20 | "at high" should be --at a high--. |
| Col. 10, line 62 | "he" should be --the--. |

UNITED STATES PATENT AND TRADEMARK OFFICE

CERTIFICATE OF CORRECTION

PATENT NO. : 4,002,304

DATED : January 11, 1977

INVENTOR(S) : Endre F. Peszeszer

It is certified that error appears in the above-identified patent and that said Letters Patent are hereby corrected as shown below:

continued:

| | |
|---|---|
| Col. 11, line 13 | "conrols" should be --controls--. |
| Col. 11, line 18 | "Th" should be --The--. |
| Col. 11, line 40 | "109" should be --209--. |
| Col. 11, line 50 | "190a 191a" should be --190a and 191a--. |
| Col. 11, line 52 | "106" should be --206--. |
| Col. 12, line 45 | "rolled" should be --trolled--. |
| Col. 12, line 61 | "Dension" should be --Denison--. |
| Col. 13, line 12 | "he" should be --the--. |
| Col. 13, line 33 | "denison" should be --Denison--. |
| Col. 14, line 59 | "The" should be --To--. |
| Col. 15, line 39 | "returing" should be --returning--. |
| Col. 15, line 55 | "hydaulic" should be --hydraulic--. |
| Col. 17, line 3 | "belt drum rim" should be --belt drive drum rim--. |

UNITED STATES PATENT AND TRADEMARK OFFICE

CERTIFICATE OF CORRECTION

PATENT NO. : 4,002,304

DATED : January 11, 1977

INVENTOR(S) : Endre F. Peszeszer

It is certified that error appears in the above-identified patent and that said Letters Patent are hereby corrected as shown below:

continued:

Col. 19, line 2 "said belt comprises" should be --said belt means comprises--.

Col. 20, line 47 "mechanism on" should be --mechanism carried on--.

Signed and Sealed this

*thirtieth* Day of *August 1977*

[SEAL]

*Attest:*

RUTH C. MASON
*Attesting Officer*

C. MARSHALL DANN
*Commissioner of Patents and Trademarks*